US008317199B2

(12) United States Patent
Hall

(10) Patent No.: US 8,317,199 B2
(45) Date of Patent: Nov. 27, 2012

(54) VIDEO POKER GAME EMPLOYING STRIPPED DECK

(76) Inventor: Geoff Hall, Solihull (GB)

( * ) Notice: Subject to any disclaimer, the term of this patent is extended or adjusted under 35 U.S.C. 154(b) by 0 days.

(21) Appl. No.: 13/021,784

(22) Filed: Feb. 6, 2011

(65) Prior Publication Data

US 2011/0218023 A1 Sep. 8, 2011

Related U.S. Application Data

(60) Provisional application No. 61/305,540, filed on Feb. 17, 2010, provisional application No. 61/302,892, filed on Feb. 9, 2010.

(51) Int. Cl.
*A63F 9/24* (2006.01)

(52) U.S. Cl. ..... 273/292; 463/13

(58) Field of Classification Search ..... 463/13; 273/292

See application file for complete search history.

(56) References Cited

U.S. PATENT DOCUMENTS

2002/0153662 A1* 10/2002 Webb et al. ..... 273/292

* cited by examiner

*Primary Examiner* — Omkar Deodhar
(74) *Attorney, Agent, or Firm* — Muskin & Cusick LLC

(57) ABSTRACT

A method, system, and computer readable storage medium to provide a variation of a video poker game. The video poker game offers the player an ability to earn having the very next game dealt from a stripped deck. A stripped deck is a standard 52 card deck with certain cards removed. For example, one type of stripped deck is a standard 52 card deck with all 2s through 9s removed, thereby providing the player with a huge advantage.

9 Claims, 9 Drawing Sheets

PRIOR ART

PRIOR ART

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| | | | | | | STRIPPED DECK |
|---|---|---|---|---|---|---|
| ROYAL FLUSH | 250 | 500 | 750 | 1000 | 4000 | all 2s-9s removed |
| STRAIGHT FLUSH | 50 | 100 | 150 | 200 | 250 | all 2s-7s removed |
| FOUR OF A KIND | 25 | 50 | 75 | 100 | 125 | all 3s-5s removed |
| FULL HOUSE | 9 | 18 | 27 | 36 | 45 | all 2s-3s removed |
| FLUSH | 6 | 12 | 18 | 24 | 30 | all 2s removed |
| STRAIGHT | 4 | 8 | 12 | 16 | 20 | |
| THREE OF A KIND | 3 | 6 | 9 | 12 | 15 | |
| TWO PAIR | 2 | 4 | 6 | 8 | 10 | |
| JACKS OR BETTER | 1 | 2 | 3 | 4 | 5 | |

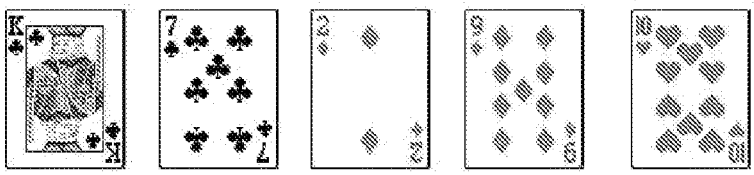

STRIPPED DECK EARNED! NO 3s-5s!

CREDITS WON: 0
COINS PLAYED:5
BALANCE: $1,120

BET ONE | BET MAX | DRAW

FIGURE 6A

| | | | | | | STRIPPED DECK |
|---|---|---|---|---|---|---|
| ROYAL FLUSH | 250 | 500 | 750 | 1000 | 4000 | all 2s-9s removed |
| STRAIGHT FLUSH | 50 | 100 | 150 | 200 | 250 | all 2s-7s removed |
| FOUR OF A KIND | 25 | 50 | 75 | 100 | 125 | all 3s-5s removed |
| FULL HOUSE | 9 | 18 | 27 | 36 | 45 | all 2s-3s removed |
| FLUSH | 6 | 12 | 18 | 24 | 30 | all 2s removed |
| STRAIGHT | 4 | 8 | 12 | 16 | 20 | |
| THREE OF A KIND | 3 | 6 | 9 | 12 | 15 | |
| TWO PAIR | 2 | 4 | 6 | 8 | 10 | |
| JACKS OR BETTER | 1 | 2 | 3 | 4 | 5 | |

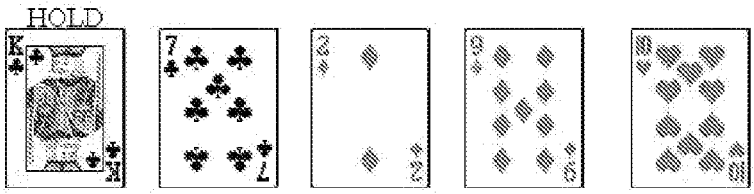

STRIPPED DECK EARNED! NO 3s-5s!

CREDITS WON: 0
COINS PLAYED:5
BALANCE: $1,120

BET ONE | BET MAX | DRAW

FIGURE 6B

| | | | | | | STRIPPED DECK |
|---|---|---|---|---|---|---|
| ROYAL FLUSH | 250 | 500 | 750 | 1000 | 4000 | all 2s-9s removed |
| STRAIGHT FLUSH | 50 | 100 | 150 | 200 | 250 | all 2s-7s removed |
| FOUR OF A KIND | 25 | 50 | 75 | 100 | 125 | all 3s-5s removed |
| FULL HOUSE | 9 | 18 | 27 | 36 | 45 | all 2s-3s removed |
| FLUSH | 6 | 12 | 18 | 24 | 30 | all 2s removed |
| STRAIGHT | 4 | 8 | 12 | 16 | 20 | |
| THREE OF A KIND | 3 | 6 | 9 | 12 | 15 | |
| TWO PAIR | 2 | 4 | 6 | 8 | 10 | |
| JACKS OR BETTER | 1 | 2 | 3 | 4 | 5 | |

HOLD

CREDITS WON: 0
COINS PLAYED:5
BALANCE: $1,120

BET ONE | BET MAX | DRAW

VIDEO POKER GAME EMPLOYING STRIPPED DECK

CROSS REFERENCE TO RELATED APPLICATIONS

This application claims benefit to provisional application 61/305,540, filed on Feb. 17, 2010, entitled Video Poker Game Employing Stripped Deck, which is incorporated by reference herein in its entirety. This application claims benefit to provisional application 61/302,892, filed on Feb. 9, 2010, entitled Video Poker Game Employing Stripped Deck, which is incorporated by reference herein in its entirety.

BACKGROUND OF THE INVENTION

1. Field of the Invention

The present inventive concept relates to a system, method, and computer readable storage, for playing a variation of the game of video poker.

2. Description of the Related Art

Video poker games are well known the art. Typically, video poker games are dealt from a standard 52 card deck or a "joker poker" deck which is a standard 52 card deck plus a joker (wild card). Some players have been growing tired of the standard video poker game and the standard rules.

What is needed is a version of video poker that is more exciting and interesting than the standard video poker game.

SUMMARY OF THE INVENTION

It is an aspect of the present general inventive concept to provide an exciting variation of video poker.

The above aspects can also be obtained by a method that includes (a) providing an electronic or physical non-standard deck of less than 52 cards; (b) receiving a wager from a player; (c) dealing a player's initial hand comprising at least three cards; (d) receiving, from the player, a selection of hold cards from the initial hand; (e) replacing non-hold cards using the deck to form a final hand; (f) evaluating a poker rank of the final hand; and (g) resolving the wager using the poker rank.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which:

FIG. 6A is a drawing of an output of a first phase of a sample second game, according to an embodiment;

FIG. 6B is a drawing of an output of a second phase of the sample second game, according to an embodiment;

DESCRIPTION OF THE PREFERRED EMBODIMENTS

Figure 1:
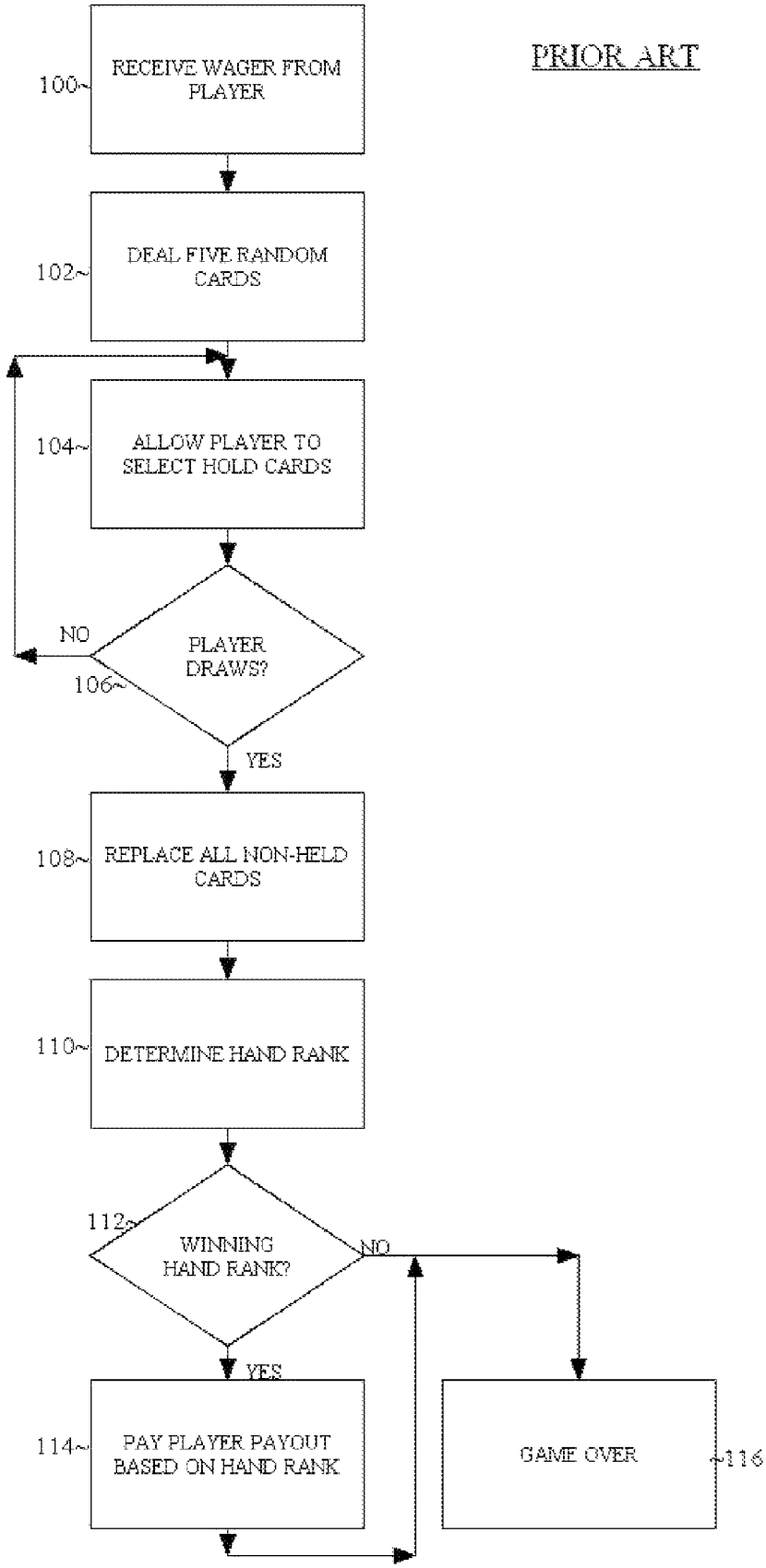
FIG. 1 is a flowchart illustrating the prior art game of video poker.

Reference will now be made in detail to the presently preferred embodiments of the invention, examples of which are illustrated in the accompanying drawings, wherein like reference numerals refer to like elements throughout.

The general inventive concept relates to a game involving video poker. Video poker is a well known game in the art, for example see U.S. Pat. No. 6,569,014, which is incorporated by reference here in its entirety.

FIG. 1 is a flowchart illustrating the prior art game of video poker. The goal is for the player to form the highest ranking poker final hand the player can make, wherein if the final hand is one of a predetermined number of winnings ranks, the player is paid for the rank of the final hand using a paytable.

The game can operate as follows. In operation 100, the machine receives a wager from a player. This is typically done by the player indicating to the machine how many credits he or she wants to bet (using buttons) and then presses a button to indicate that he or she wishes to begin a new game, upon which the number of credits bet is deducted from the player's credit meter. Initially, the player can make a cash deposit (or use a ticket/voucher, or electronic form of payment) in order to fund the credits in the machine.

From operation 100, the method proceeds to operation 102, which deals five random cards to the player. This can be considered the player's initial hand. Typically, a single standard 52 card deck is used, although in other variations, other types of decks can be used as well (e.g., decks with one or more wildcards). The five cards are typically dealt face up.

From operation 102, the method proceeds to operation 104, which allows the player to select the player's hold cards in the initial hand. The player's hold cards are cards which the player wishes to keep. Cards which are not hold cards are considered "discard cards." The player can indicate which of the cards are hold cards by touching the desired hold cards (on a touch-screen machine) or by pressing buttons. The player can also touch a card with "hold card" status and the status can be changed to no longer be a hold card.

From operation 104, the method proceeds to operation 106, which determines whether the player draws. In order to draw, the player can press a draw button which initiates a draw. If the player does not draw, the player is free to continue to change the desired hold cards (in operation 104) until the player is satisfied with his or her choice.

Once the player draws in operation 106, the method proceeds to operation 108, which replaces all the discard cards in the initial hand (cards which are not indicated as hold cards) with newly dealt cards from the virtual deck in order to form a final hand.

From operation 110, the method proceeds to operation 112, which determines a hand rank of the final hand. This can be done by comparing the cards in the final card to determine if they meet a particular defining criteria. Table I below is an exemplary video poker paytable which comprises a list of video poker hand ranks, although it can be appreciated that different variants of video poker can use different hand ranks and payouts.

TABLE I

| Hand | payout |
|---|---|
| Royal Flush | 250 |
| Straight Flush | 50 |
| Four of a Kind | 25 |
| Full House | 9 |
| Flush | 6 |
| Straight | 4 |
| Three of a Kind | 3 |
| Two Pair | 2 |
| Jacks or Better | 1 |
| Anything else | 0 |

From operation 112, the method proceeds to operation 112 which determines if the final hand is a winning hand rank. A winning hand rank is a rank on the paytable being used that has a payout greater than 0.

If the final hand rank is a winning rank, then the method proceeds to operation 114, which pays the player based on the hand rank. The payout is determines using a respective entry in the paytable which corresponds to the winning final hand rank multiplies by the number of coins bet. The payout is typically made in the form of credits that can be cashed out for real coins, or a ticket redeemable for cash at a kiosk, when the player wishes. From operation 114, the method proceeds to operation 116, wherein the game ends.

If the final hand rank is not a winning rank, then the method proceeds to operation 116, wherein the player is not paid a payout and the game ends. Of course, the player is free to begin a new game (by pressing appropriate buttons) and start again at operation 100 if the player so wishes.

Figure 2:
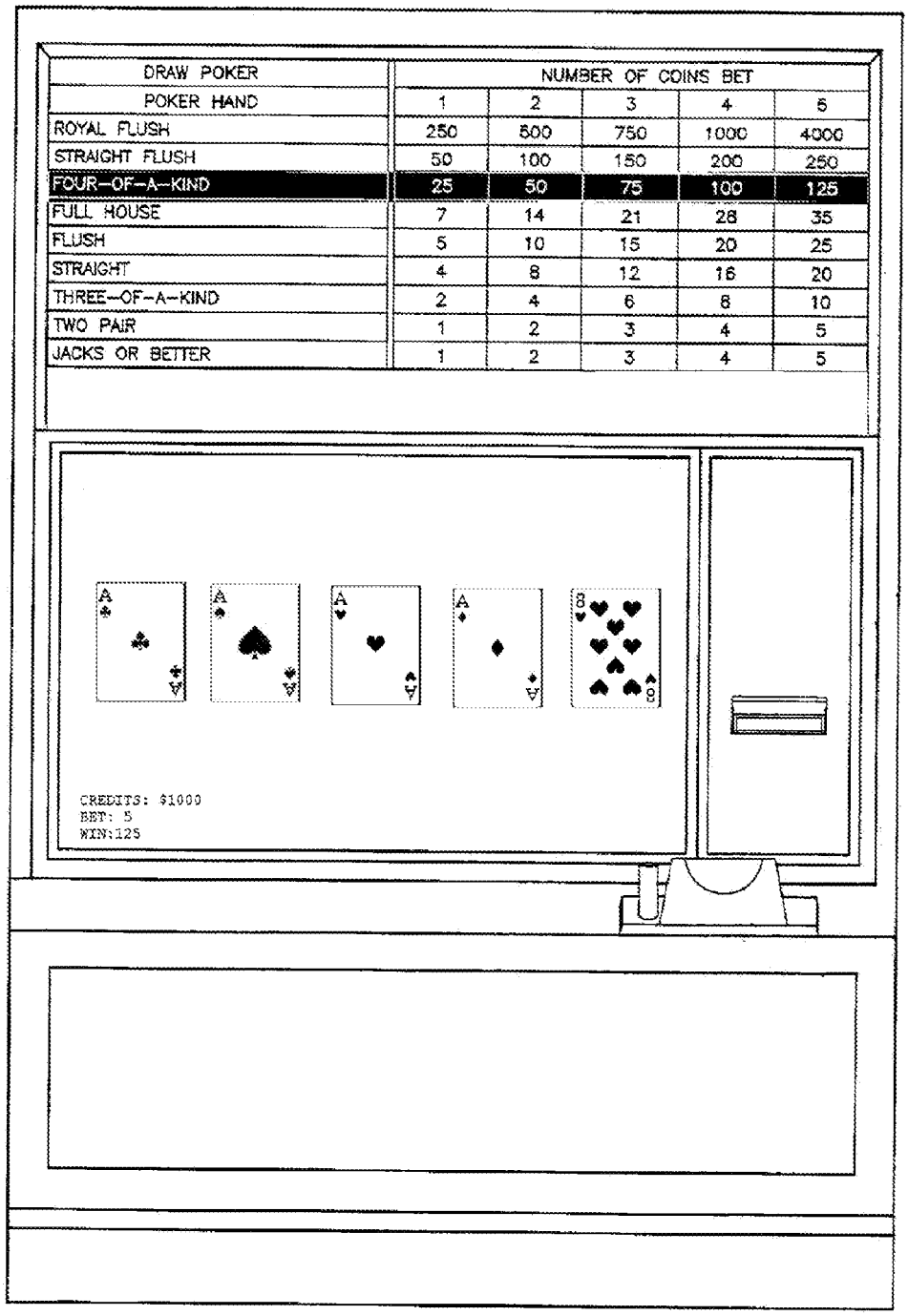
FIG. 2 is a drawing of one example of a video poker machine that can be used to implement methods herein, according to an embodiment.

FIG. 2 is a drawing of one example of a video poker machine that can be used to implement methods herein, according to an embodiment. Of course other types of machines can be used as well, including playing over the internet using a personal computer.

One deficiency in the method illustrated in FIG. 1 is that the player may find the game mundane and not sufficiently challenging. One way that the game of video poker can be made more exciting is by implementing a method wherein based on a rank of a final hand earned in a game, the player can earn the ability to use a stripped deck on a subsequent hand. A stripped deck is a deck of cards that can come in numerous varieties that has less than the standard 52 cards in it. For example, the following are all examples of stripped decks: a deck will all four 2's removed; a deck with all 2s-9s removed (20 cards remaining); a deck with a particular suit removed (e.g., a 39 card deck with no spades); a deck with all 6's and 10's removed. These are just a few examples of stripped decks, as there are numerous examples of such a deck.

Using a stripped deck could provide a player with an advantage. For example, player a game of video poker using a deck with all 2's-9's removed, provides the player with a high expected return on his initial wager. This is because using this particular deck, the player is more likely to either: make a royal flush; make a straight flush; get a high pair; get three of a kind or four of a kind, etc.

Of course, the casino could not offer such a deck to players using standard paytables because the player would have the advantage. Thus, in an embodiment of the inventive concept described herein, the player has the ability to earn the privilege of getting to play using a stripped deck on a subsequent hand by getting a qualifying hand. For example, if the player receives a predetermined hand on the deal or on the draw of a regular game (using a regular deck), then on the next hand the player can play a game of video poker using a stripped deck (both on the deal and the draw). Alternatively, the stripped deck could only be use for the deal and not the draw. In another embodiment, the deal can be dealt from a standard deck but the draw would be dealt from a stripped deck.

Figure 3:
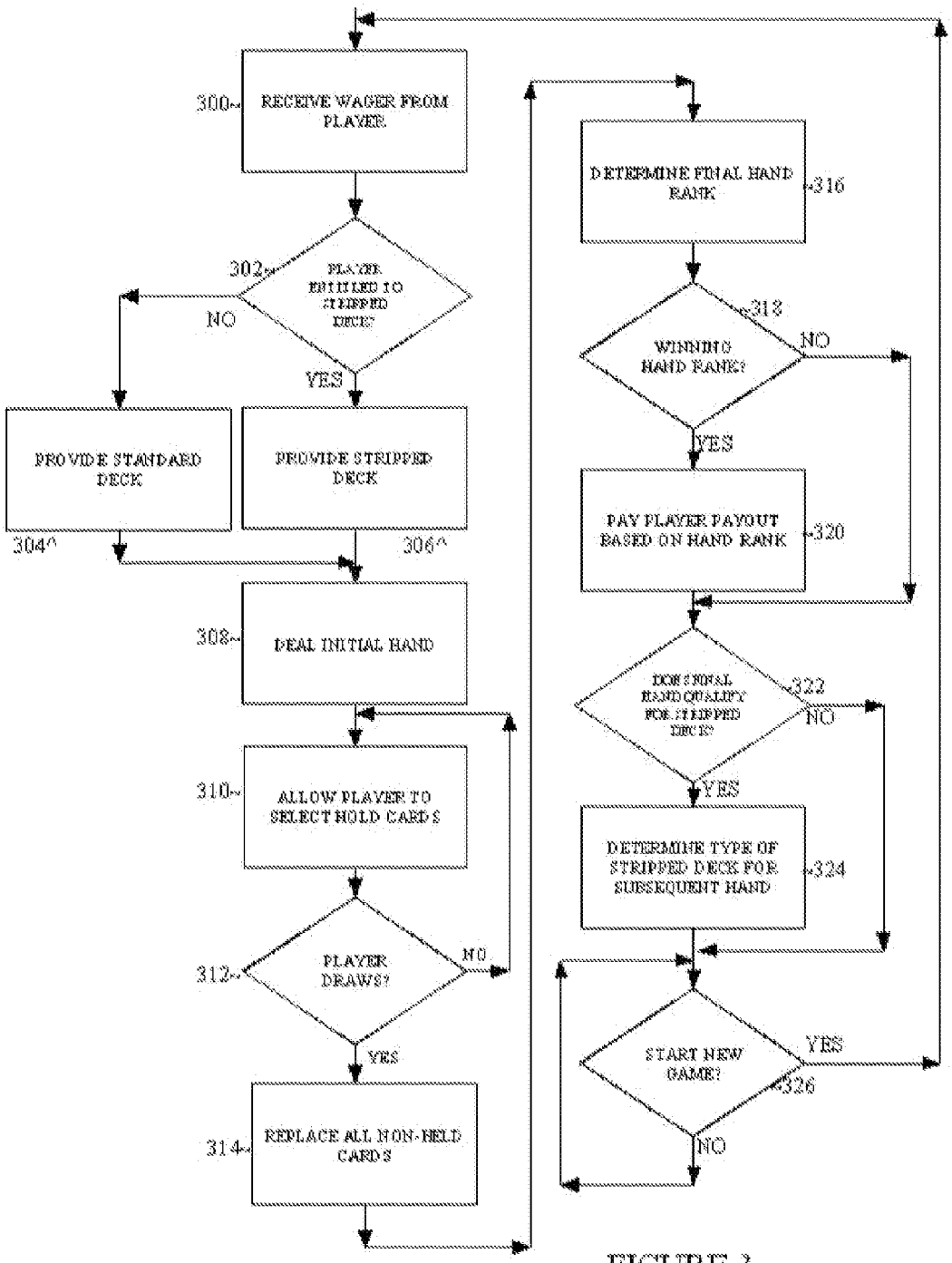
FIG. 3 is a flowchart illustrating an exemplary method of implementing a video poker game that can offer a stripped deck, according to an embodiment.

FIG. 3 is a flowchart illustrating an exemplary method of implementing a video poker game that can offer a stripped deck, according to an embodiment.

The method can begin with operation 300, which receives a wager from a player. This can be done as known in the art, which is typically done by deducting the wager amount from the player's credit meter. The credit meter can be filled up initially by inserting cash into the machine which credits the credit meter for the amount of cash inserted. Upon cashing out, the player can convert the current credits in the credit meter to cash, or to a cashless ticket directly redeemable for the cash amount of credits.

From operation 300, the method proceeds to operation 302, which determines whether the player is entitled to a stripped deck. This determination can be made based on what occurred in the preceding game (operation 322). A variable can be used to store the status of what has been earned in the previous game.

If the player has not earned a stripped deck from the preceding hand, then the method proceeds to operation 304, which provides a standard 52 card deck for dealing and drawing in operations 308 and 314. To "provide" a standard deck in this context means using instructions to index a standard deck in the computer's memory for operations 308 and 312. Alternative to a standard deck, a wild deck (standard deck plus one or more wild cards) can also be used in operation 304 if the game is "joker poker" (video poker with a wild card). The deck is typically shuffled. The method then proceeds to operation 308, which deals the initial hand using the provided standard deck.

If in operation 302, it is determined that the player is entitled to a stripped deck, then the method proceeds to operation 306 which provides a stripped deck to the player. The exact type of stripped deck (stripped decks can come in many types) can be determined from a variable set in operation 324 (which was performed in the previous game). The type of stripped deck earned can be set up and pointed to for operations 308 and 312. This can be done in numerous ways, for example, a standard 52 card deck can be set in an array, and then the cards to be removed are removed from the array, and any empty spaces can be removed. In this way, the computer has an array (or index) or card values (each value comprises a card rank and a card suit) of some cards in the deck but not the cards that are absent from the type of stripped deck used. The deck is typically shuffled.

From operations 304 or 306, the method then proceeds to operation 308, which deals an initial hand. This uses the type of deck that was provided for in either operations 304 or 306 (whichever was reached). The dealing displays five random cards from the deck (or 5 top cards from a randomly shuffled deck) face up to the player.

From operation 308, the method proceeds to operation 310, which allows a player to select hold cards. Hold cards are the cards that player does not wish to discard. If the player does not wish to discard any cards, then the player would hold all five cards. The player can indicate his or her selection of hold cards by touching the desired hold cards on a touch-screen display. Thus, each of the dealt cards has a status of "hold" or "non-held." Typically, a hold card can be turned into a non-held card by touching it again. The player can continue to select/deselect hold cards until the player is happy with his or her choice, upon which the player can then press a "draw" button to draw.

From operation 310, the method proceeds to operation 312, which determines whether the player has decided to draw (by pressing a draw button). If the player has not yet drawn, then the method proceeds to operation 310, which continues to receive the player's selection of hold cards.

From operation 312, if the player draws, then the method proceeds to operation 314, wherein the non-held cards are replaced with newly dealt cards from the provided deck (the deck provided in either operation 304 or 306). Since all discarded cards are replaced, the player's hand would still comprise five cards, which would now be considered the player's final hand.

From operation 314, the method proceeds to operation 316, which determines a final hand rank (a poker rank of the final hand). This can be done by comparing the cards in the final hand against predetermined poker ranks (for example, see Table I). Winning hands have a winning payout associated with them, while a non-winning hand (losing hand) would have a payout of 0.

From operation 316, the method proceeds to operation 318, which determines whether the final hand (from operation 314) is a winning hand rank (a hand rank with a payout greater than zero). If the player did not earn a winning hand, then the player does not get a payout and the method proceeds to operation 322.

If in operation 318, the player is entitled to a winning payout, then the method proceeds to operation 320, which pays the player a payout associated with the winning hand rank. This is typically done by adding the respective amount of credits to the player's credit meter. The method can then proceed to operation 322.

From either operation 318 or 320, the method proceeds to operation 322, which determines whether the player qualifies for a stripped deck on the next hand. This determination can be made based on a number of predetermined criteria or criterion. For example, if the final hand rank is a particular rank(s), the player may be entitled to a stripped deck. Table II is one example of final hand ranks and a type of stripped deck that hand may earn. The stripped deck column refers to a standard 52 card deck with the mentioned cards removed.

TABLE II

| Hand | stripped deck earned |
|---|---|
| Royal Flush | all 2s-9s removed |
| Straight Flush | all 2s-7s removed |
| Four of a Kind | all 2s-5s removed |
| Full House | all 2s-3s removed |
| Flush | all 2s removed |
| Straight | none |
| Three of a Kind | none |
| Two Pair | none |
| Jacks or Better | none |
| Anything else | none |

For example, according to Table II, if the player got a final hand of three of a kind (in operation 316) then the player would not be entitled to a stripped deck for the very next hand. If the player got a final hand of full house (in operation 316), then the very next hand would use a stripped deck which has all 2s-3s removed (44 cards, 1 cards of each suit (4 cards) for A, 4, 5, 6, 7, 8, 9, 10, J, Q, K).

If in operation 322, it is determined the player is not entitled to a stripped deck then this fact can be noted in the computer system (e.g., a register, variable etc. that can be referred to in operation 302) to ensure that the next hand does not give the player a stripped deck, and then the method proceeds to operation 326.

If in operation 322, it is determined that the player is entitled to a stripped deck, then the method proceeds to operation 324, which determines a type of stripped deck to use for the subsequent hand. This can be done using a table such as Table II which associates particular types of stripped decks with final hands. The type of stripped deck to be used for the very next (subsequent or successive) hand is then stored in a variable or register which can then be referred to in operation 306. A separate variable may also be used (by operation 302) to determine if the player has even earned a stripped deck, and if this is used, then such a variable should be modified accordingly as well.

From operations 322 or 324, the method proceeds to operation 326, which determines whether the player begins a new game (typically by pressing a button on the electronic gaming device). If the player has earned a stripped deck, the player would be unwise to leave the machine (possibly cashing out) because the very next hand would typically be advantageous for the player. Once the player decides to begin a new game, the method can return to operation 300, which begins a new game, subject to potentially using a stripped deck depending on the most recent occurrences.

It is further noted that special handling may be utilized when the player is playing with a stripped deck. For example, in one embodiment, when the player is playing with a stripped deck, the player would be ineligible to earn a stripped deck again on the very next hand. Thus, when the player is playing with a stripped deck (has reached operation 306), when the player makes it to operation 322 the player will never qualify for a stripped deck on the very next (subsequent) hand and will play the next hand with a standard deck. In another embodiment, when the player is playing with a stripped deck (operation 306), the player would be able to qualify for another stripped deck on the very next hand in the same manner as if the player was not playing with a stripped deck (in other words, playing with a stripped deck has no effect on the right to earn another stripped deck). In a further embodiment, when the player is playing with a stripped deck, he may be presented with different stripped deck options. For Example, if Table II illustrates the stripped decks that the player could earn if the player gets the respective hands playing a normal game (not from a stripped deck), then when the player has a stripped deck the player can be presented with a different set of stripped decks for different outcomes. See Table III below which illustrates (in the second column) a stripped deck a player can earn (a standard 52 card deck with those cards removed) when the player is playing with a normal deck, and (in the third column) a stripped deck the player can earn (a standard 52 card deck with those cards removed) when the player is already playing (reached operation 306) with a stripped deck from column 2. When the player is playing with a stripped deck from the third column (earned a stripped deck on a stripped deck), the player may either: be a) ineligible for another stripped deck; or b) be able to earn the same stripped decks available in column three; or c) be able to earn a different set of potential stripped decks.

TABLE III

| Hand | stripped deck earned | stripped deck earned on stripped deck |
|---|---|---|
| Royal Flush | all 2s-9s removed | none |
| Straight Flush | all 2s-7s removed | all 4s-6s removed |
| Four of a Kind | all 2s-5s removed | all spades, clubs removed |
| Full House | all 2s-3s removed | none |
| Flush | all 2s removed | all 3s removed |
| Straight | none | none |
| Three of a Kind | none | none |
| Two Pair | none | all 2s removed |
| Jacks or Better | none | none |
| Anything else | none | none |

It is appreciated that the examples in Tables II and III are merely examples for illustrative purposes, and different sets of stripped decks associated with different conditions can be used.

In a further embodiment, instead of just earning one subsequent stripped deck (in operation 324), the player can earn multiple new games with the stripped decks (e.g., 2 new games with the stripped deck, or X new games), before the game reverts back to a normal game. Thus, when operation 324 is reached, it sets a counter which counts for X games before the game reverts back to a stripped deck. Thus, for example, each time the player earned a stripped deck the player gets to earn two games with that stripped deck (instead of just one as described in FIG. 3). In this multiple stripped game embodiment, a player may or may not be eligible to earn further stripped decks while playing with a stripped deck.

In another embodiment, the player can receive a stripped deck on every game the player plays (as opposed to the player having to earn the stripped deck) by paying an additional amount of coins per game played (e.g., for every 5 coins bet, the player has to bet an addition X coins, wherein X can be 1 to 10 or more). Alternatively, the player does not have to bet extra coins but instead can play with a stripped deck but winning hands are paid using a depressed paytable (payouts are lower than a standard paytable). Using either of these methods, the player can be entitled to always play using a stripped deck (instead of having to earn the stripped deck as in FIG. 3).

Figure 4A:
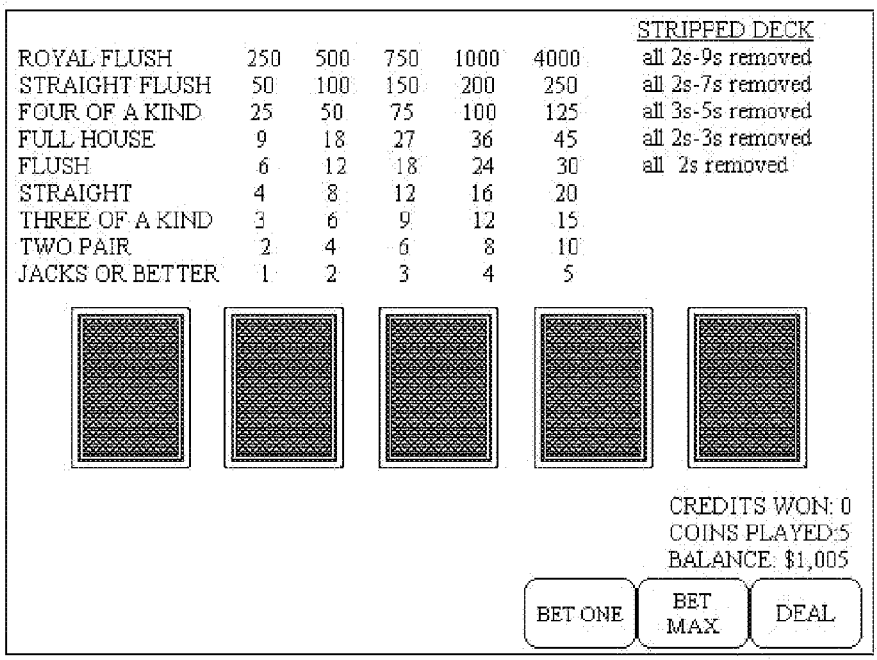
FIG. 4A is a drawing of an output of a first phase of a sample first game, according to an embodiment.

FIG. 4A is a drawing of an output of a first phase of a sample first game, according to an embodiment.

Figure 4B:
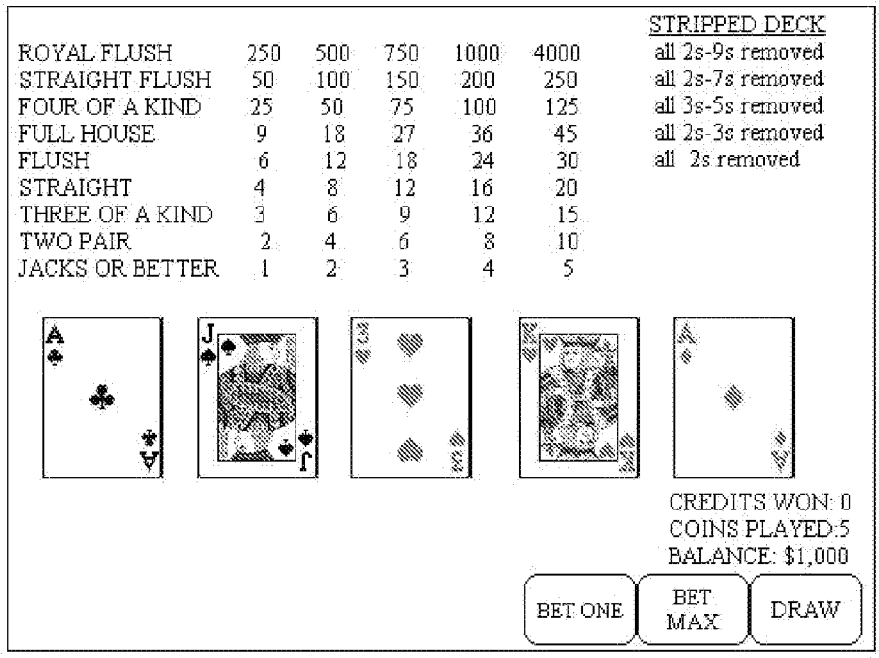
FIG. 4B is a drawing of an output of a second phase of the sample first game, according to an embodiment.

A player bets five coins at a video poker machine and then presses the "deal" button which begins the game (operation 300) and proceeds to FIG. 4B.

FIG. 4B is a drawing of an output of a second phase of the sample first game, according to an embodiment.

The player's wager (five coins) is deducted from the player's credit meter and the game begins. The player (based on a prior game) is not entitled to a stripped deck (operation 304). Also, even if the player was entitled to a stripped deck, but a new player plays at the machine (which can be detected by a player removing his or her loyalty card) or if a predetermined amount of time passes before a new game is begun (e.g., fifteen minutes), the player would lose any entitlements the machine may have had to a stripped deck.

The player is dealt (operation 308) five random cards from a standard 52 card deck: ace clubs, jack spades, three hearts, king hearts, ace diamonds.

Figure 5A:
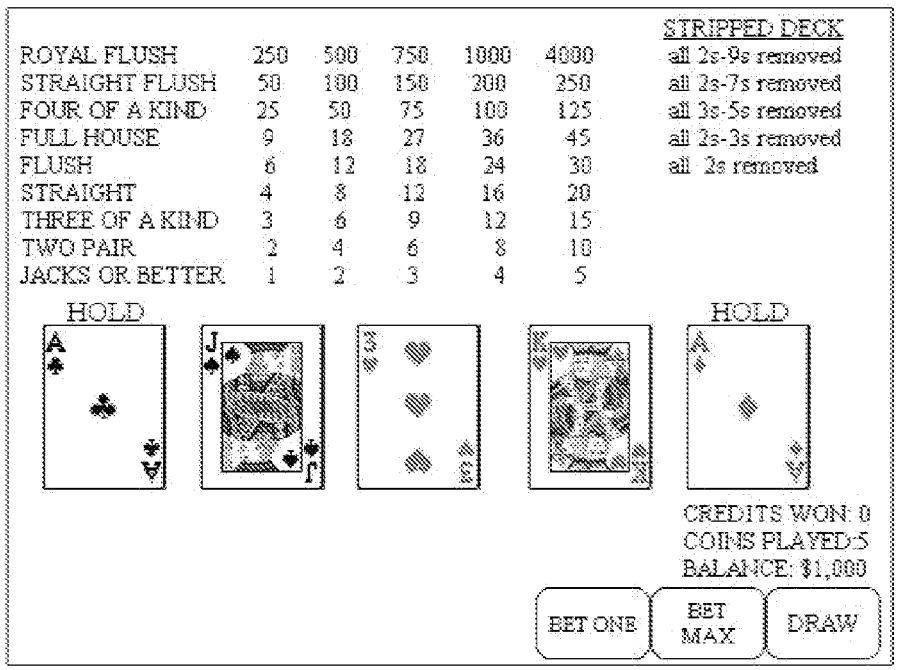
FIG. 5A is a drawing of an output of a third phase of the sample first game, according to an embodiment.

FIG. 5A is a drawing of an output of a third phase of the sample first game, according to an embodiment.

From FIG. 4B, the player now has the opportunity to select the hold and non-hold (or "non-held") cards. The player decides to hold (operation 310) the ace clubs and the ace of diamonds. The player then presses the "draw" button (operation 312), bringing up FIG. 5B.

Figure 5B:
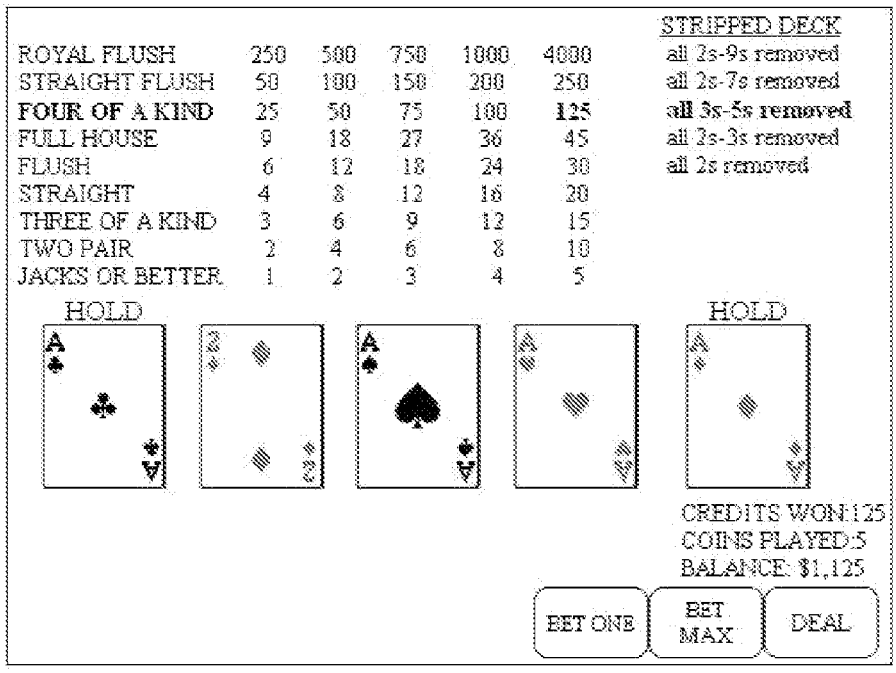
FIG. 5B is a drawing of an output of a fourth phase of the sample first game, according to an embodiment.

FIG. 5B is a drawing of an output of a fourth phase of the sample first game, according to an embodiment.

The game now automatically replaces (operation 314) the non-held cards (the jack spades, three hearts, king hearts) with three new cards from the standard deck (of course the non-held cards are removed from the deck and cannot be dealt again in this game) to create a final hand: ace clubs, two diamonds, ace spades, ace hearts, ace diamonds.

The hand rank of the final hand is determined (316) to be a four of a kind, which is a winning hand rank. Since four of a kind is determined (operation 318) to be a winning hand, the player is paid (operation 320) the respective payout for four of a kind which is added to the player's credit meter.

According to the paytable used, the final hand rank of four of a kind also entitles the player (operation 324) to play the very next hand using a stripped deck which is a standard 52 card deck with all of the 3s, 4, and 5s removed (12 cards removed since there are four cards of each rank), meaning the stripped deck will use exactly 40 cards. Note that the paytable highlights the winning final hand ("four of a kind") the payout (125 coins) and the stripped deck earned ("all 3s-5s removed").

At this point the player should typically be excited that he or she gets to play the next hand with a stripped deck which should provide the player with an advantage over playing with a standard 52 card deck. The player can then start a new game by pressing the deal button to pay for and play a new game, which proceeds to FIG. 6A.

FIG. 6A is a drawing of an output of a first phase of a sample second game, according to an embodiment.

The player has paid five coins for a new game, which provides (operation 306) the stripped deck of the kind earned previously (a standard deck with all 3s-5s removed). The cards dealt (operation 308) are: king clubs, seven clubs, two diamonds, nine diamonds, ten hearts. Note that none of these cards are 3s, 4s, or 5s, which are removed from the deck.

FIG. 6B is a drawing of an output of a second phase of the sample second game, according to an embodiment.

From FIG. 6A, the player now decides to hold (operation 310) the king of clubs. The player then presses the draw button to proceed to FIG. 7.

Figure 7:
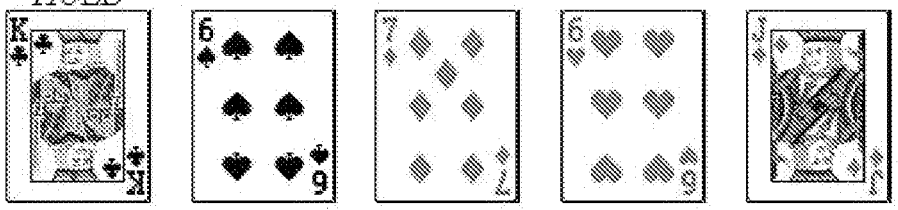
FIG. 7 is a drawing of an output of a third phase of the sample second game, according to an embodiment.

FIG. 7 is a drawing of an output of a third phase of the sample second game, according to an embodiment.

The game then replaces (operation 314) the non-held cards with: six spades, seven diamonds, six hearts, and jack diamonds. Note that none of the replacement cards are 3s, 4s, or 5s, which have been removed from the deck.

This final hand has a hand rank of "nothing" in that it is a losing hand. It pays nothing, and also does not earn the player the right to get a stripped deck on the very next hand.

It is further noted that in another embodiment, losing hands (hands that do not earn a payout) may still qualify the player for using a stripped deck on the very next hand. For example, a hand comprising all five black cards is a losing hand, but this still may qualify for the player for a stripped deck as a consolation prize.

Described above was a game that offered the stripped deck (when earned) for both the initial deal (operation 308) and the draw (operation 314). In another embodiment, the stripped deck is only offered on the deal but not the draw, which then is dealt from a standard 52 card deck (although the cards dealt on the initial deal are not present again in the deck and cannot be dealt again). In a further embodiment, the stripped deck is not offered on the deal (which is dealt from a standard deck) but only offered on the draw (which is dealt from a stripped deck earned which also would not have the initially dealt cards in it).

In another embodiment, the right to earn a stripped deck on a successive hand is not earned based on the final hand, but based on the initial hand dealt (in operation 308). Thus for example, if the initial hand comprises a predetermined hand or rank (e.g., three of a kind), then the very next game (not the draw in operation 314 but the next new game starting in operation 300) would then be dealt from the stripped deck.

Figure 8:
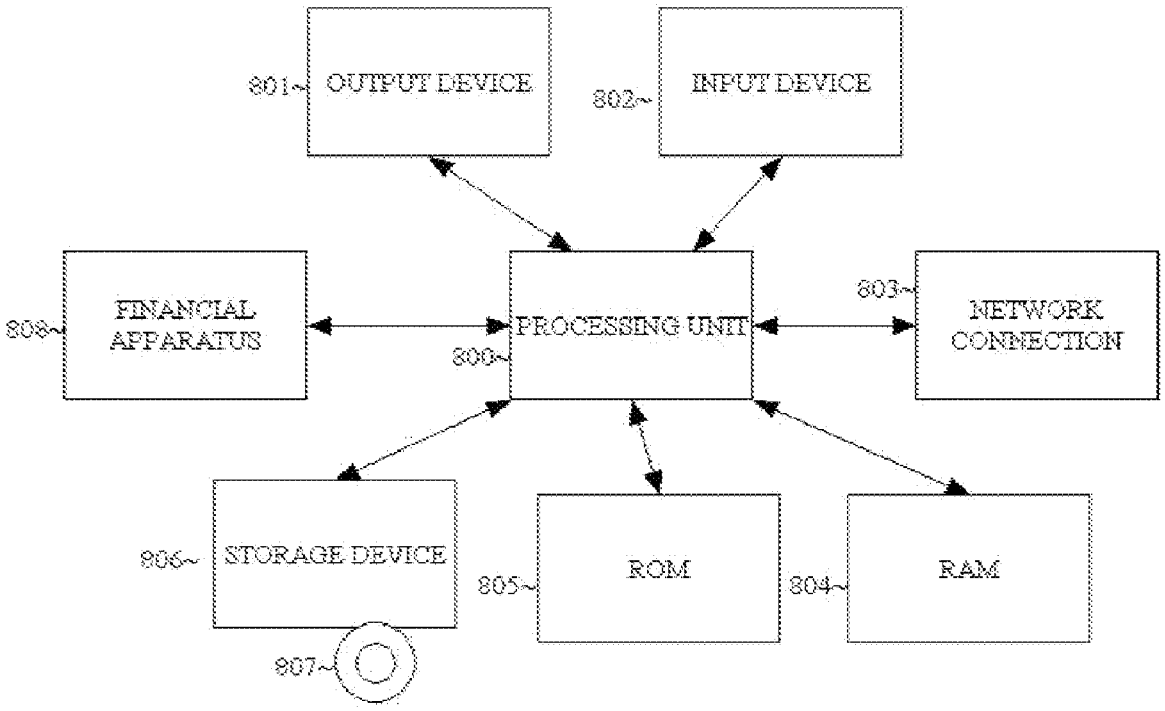
FIG. 8 is a block diagram illustrating sample hardware that can be used to implement the methods described herein, according to an embodiment.

FIG. 8 is a block diagram illustrating sample hardware that can be used to implement the methods described herein, according to an embodiment.

The hardware can be, for example, an electronic gaming machine (EGM) used in casinos. The hardware can also be a personal computer, playing the game using the Internet at an Internet casino for real money.

A processing unit 800 (such as a microprocessor and any associated components) is connected to an output device 801 (such as an LCD monitor, touch screen, CRT, etc.) and an input device 802 (e.g., buttons, a touch screen, a keyboard, mouse, etc.) The processing unit 800 executes instructions that are pre-programmed and stored in a storage accessible by the processing unit 800. All operations described herein can be executed on the processing unit 800. The processing unit 800 can also be connected to a network connection 803, which can connect the electronic gaming device to a computer communications network such as the Internet, a LAN, WAN, etc. The processing unit 800 is also connected to a RAM 804 and a ROM 805. The processing unit 800 is also connected to a storage device 806 which can be a DVD-drive, CD-ROM, flash memory, etc. A computer readable storage medium 807 can store a program which can control the electronic device to perform any of the methods described herein. The processing unit 800 can also be connected to a financial apparatus 808 which can receive cash and convert the received cash into playable credits for use by the player when playing the electronic device. When the player decides to cash out any remaining credits, the financial apparatus 808 can issue coins or a cashless ticket (voucher) for the remaining credits which is redeemable by the player.

In a further embodiment, a stripped deck can be awarded based purely on a random determination, without regard to a previous hand. For example, before the initial hand is dealt, the player can be entitled to a particular stripped deck (e.g., a standard 52 card deck with all 2s through 9s removed (20 cards in the deck), or any other type of stripped deck described herein), based on a random determination (e.g., the player has a 1 in X chance of getting a stripped deck, where X can be 30 or any number). In a further variation of this embodiment, the more coins the player bets, the greater the player's chance of getting a stripped deck.

Figure 9:
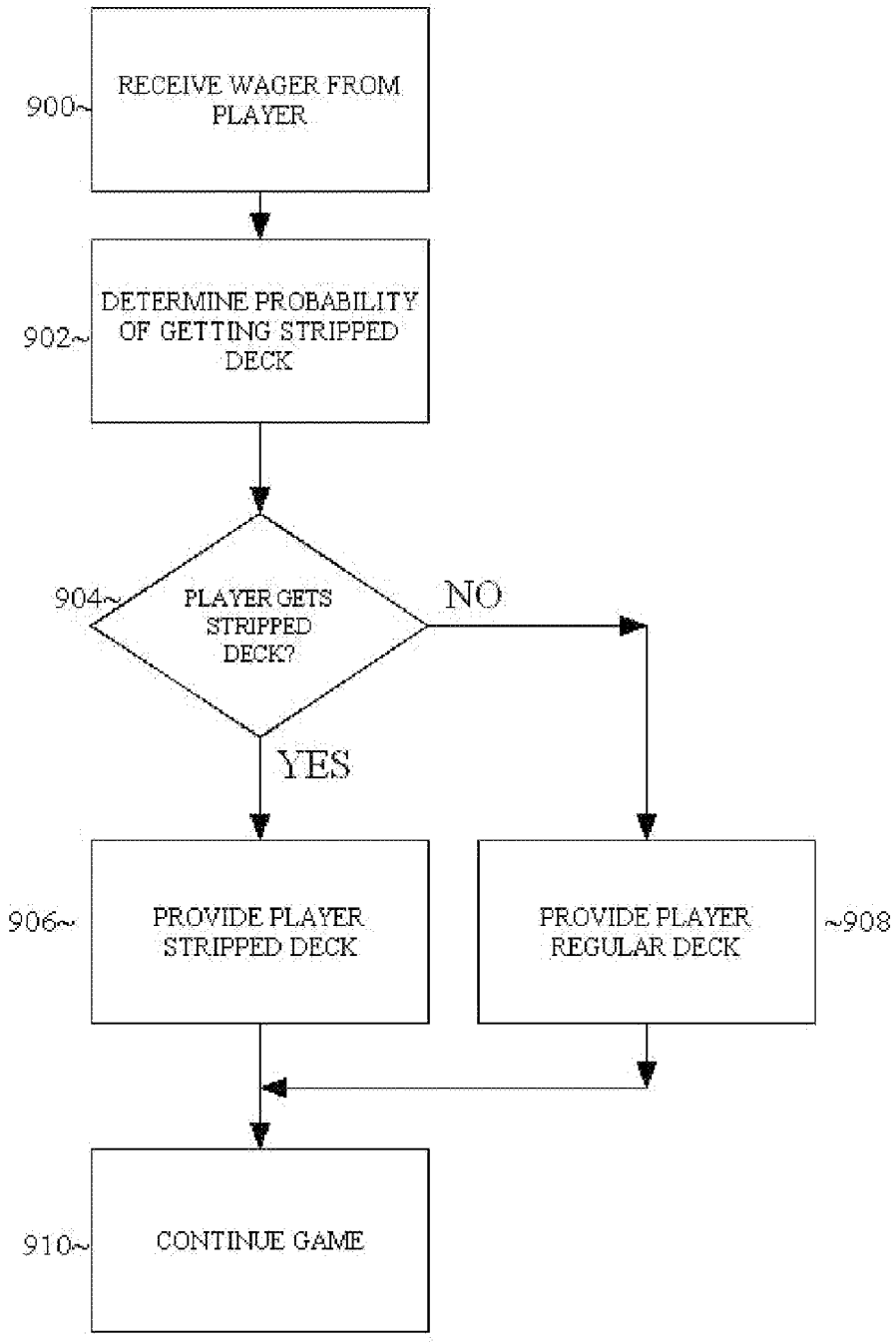
FIG. 9 is a flowchart illustrating an exemplary method of awarding stripped decks, according to an embodiment.

FIG. 9 is a flowchart illustrating an exemplary method of awarding stripped decks, according to an embodiment.

The method can begin with operation 900, which receives the player's initial wager. This is similar to operation 100. However, the player may be required to bet an extra coin(s) for the opportunity to get a stripped deck.

From operation 900, the method proceeds to operation 902, which determines the probability of getting the stripped deck. In a simplest embodiment, the probability will be fixed (e.g., 1/30 chance).

From operation 902, the method proceeds to operation 904, which determines whether the player actually gets the stripped deck. This is done based on picking a random number (or other mechanism to make a random determination) in accordance with the probability determined in operation 902.

If, in operation 904, it is determined that the player is provided with a stripped deck, then the method proceeds to operation 906 which provides the player with a stripped deck for the game.

If, in operation 904, it is determined that the player is not provided with a stripped deck, then the method proceeds to operation 908, which provides the player with a regular deck for the game.

From operations 906 or 908, the method proceeds to operation 910, which continues the game normally using the deck provided in either operation 906 or 908. Thus, for example, the game can continue at operation 102 from FIG. 1 like a standard video poker game, but with the type of deck (stripped or standard) deck used. If the player is provided with a stripped deck, then in addition to the initial deal (operation 102) being dealt with the stripped deck, the draw (operation 108) would also be dealt with the stripped deck.

In a further variation of FIG. 9 (which uses a fixed probability of getting a stripped deck and a predetermined number of extra coin(s)), a player may (at the player's choice) bet more coins to increase the probability of getting a stripped deck. In operation 900, the player can choose to bet a number of extra coins (e.g., 1 to 5 extra coins in addition to betting five coins for the standard game), with each extra coin over 5 providing the player the advantage of an increased chance at getting the stripped deck. Betting (for example) 1-5 coins would not provide for a stripped deck (according to Table IV) but coins in excess of 1 coin (up to 5 coins) would increase the payouts (e.g., multiply payouts by the number of coins bet). But once 6 coins are bet, the payouts would no longer increase (the payouts would be the same as if 5 coins were bet) but what increases is the probability of getting a stripped deck. Table IV below illustrates a number of coins bet and the probability of getting a stripped deck (the stripped deck can be, for example, a 20 card deck that contains only 10's, jacks, queens, kings, and aces in each of the four suits).

TABLE IV

| Coins bet | probability of getting a stripped deck |
|---|---|
| 0-5 | 0 in 30 |
| 6 | 1 in 30 |
| 7 | 2 in 30 |
| 8 | 3 in 30 |
| 9 | 4 in 30 |
| 10 | 5 in 30 |

Thus, the player can choose to bet 0-5 coins and receive a standard game without a chance of getting a stripped deck. Or the player can choose to bet six coins and the player would have a 1 in 30 chance of getting a stripped deck (with payouts the same if 5 coins were bet). Or the player can choose to bet seven coins and the player would have a 2 in 30 chance of getting a stripped deck, etc. The player can indicate his or her choice of how many coins to bet (in operation 900) by indicate such on a touch-screen display or physical buttons associated with the machine. Operation 902 would determine the probability of getting the stripped deck based on the number of coins bet (using a table such as Table IV). Operation 904 would make the determination of whether the player gets the stripped deck based on the probability determined in operation 902.

Table V illustrates sample payouts that can be used, for example with the probabilities from Table IV, but of course it can be appreciated that any other video poker paytable can be used as well. Payouts shown are for 5 coins bet (of course the payout can be reduced proportionally for fewer coins bet). However, betting more than 5 coins (e.g., 6-10 coins) does not increase the payout but does increase the probability of getting the stripped deck (according to Table IV).

TABLE V

| Hand | payout |
|---|---|
| Royal Flush | 4000 |
| Straight Flush* | 250 |
| Four of a Kind | 125 |
| Full House | 45 |
| Flush* | 30 |
| Straight | 20 |
| Three of a Kind | 15 |
| Two Pair | 10 |
| Jacks or Better | 5 |
| Anything else | 0 |

*These hands are not possible with the stripped deck of 20 cards that contains only 10's, jacks, queens, kings, and aces in each of the four suits It is noted that the methods described herein are typically played with a single deck of cards, although in other embodiments more than one deck can be used. A standard deck of 52 cards can be used, as well as other kinds of decks, such as Spanish decks, decks with wild cards, etc. The operations described herein can be performed in any sensible order. Furthermore, numerous different variants of house rules can be applied.

Methods herein can be applied to any version of video poker, such as (but not limited to) double bonus, double double bonus, joker poker, deuces wild, etc. Methods described herein can also be applied to a casino player versus dealer poker game, wherein a player tries to make his or her best poker hand by discarding and drawing cards, and then comparing their hand against a dealer's hand.

Initial cash deposits can be made into the electronic gaming machine which convert cash into electronic credits. Wagers can be placed in the form of electronic credits, which can be cashed out for real coins or a ticket (e.g., ticket-in-ticket-out) which can be redeemed at a casino cashier or kiosk for real cash and/or coins.

The descriptions provided herein also include any hardware and/or software known in the art and needed to implement the operations described herein. Further, all methods described herein can be programmed on a digital computer and stored on any type of computer readable storage medium.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to play video poker, the method comprising:

executing instructions on a processing unit, the processing unit operationally connected to an input device and an output device, the instructions performing:

receiving a first wager and allowing the player to complete a first video poker game;

determining, based on an event in the first video poker game, whether a second video poker game qualifies for a stripped deck, wherein the stripped deck used comprises a standard 52 card deck with particular cards removed;

receiving a second wager to player the second video poker game;

dealing an initial poker hand from a stripped deck if the determining determines that the second video poker game qualifies for the stripped deck otherwise the initial poker hand is dealt from a standard deck;

allowing the player to indicate non-held cards from the initial poker hand;

replacing the non-held cards in the initial poker hand to form a final poker hand; and paying the player any earned award based on the final poker hand.

2. The method as recited in claim 1, wherein the determining whether the second video poker game qualifies for a stripped deck is determined based on a first video poker game final hand.

3. The method as recited in claim 1, wherein the determining whether the second video poker game qualifies for a stripped deck is determined based on a first video poker game initial hand.

4. The method as recited in claim 1, wherein if the initial poker hand is dealt from a stripped deck, a type of stripped deck used is based on a first video poker game final hand.

5. The method as recited in claim 1, wherein if the initial poker hand is dealt from a stripped deck, a type of stripped deck used is based on a first video poker game initial hand.

6. The method as recited in claim 1, wherein the stripped deck used comprises a standard 52 card deck with all cards of a particular rank removed.

7. The method as recited in claim 1, wherein the stripped deck used comprises a standard 52 card deck with all cards of at least two particular ranks removed.

8. The method as recited in claim 1, wherein if a stripped deck is used for the dealing an initial poker hand, then the stripped deck is also used for the replacing.

9. A method to play video poker, the method comprising:

executing instructions on a processing unit, the processing unit operationally connected to an input device and an output device, the instructions performing:

receiving a first wager and allowing the player to complete a first video poker game;

determining, based on an event in the first video poker game, whether a second video poker game qualifies for a stripped deck wherein the stripped deck used comprises a standard 52 card deck with particular cards removed;

receiving a second wager to player the second video poker game;

dealing an initial poker hand from a standard deck;

allowing the player to indicate non-held cards from the initial poker hand;

replacing the non-held cards in the initial poker hand with replacement cards to form a final poker hand, the replacement cards are dealt from the stripped deck if the determining determines that the second video poker game qualifies for the stripped deck otherwise the replacement cards are dealt from a the standard deck; and paying the player any earned award based on the final poker hand.

* * * * *